US008203093B2

(12) United States Patent
Wang et al.

(10) Patent No.: US 8,203,093 B2
(45) Date of Patent: Jun. 19, 2012

(54) PUSHBUTTON FOR ELECTRONIC DEVICE

(75) Inventors: Wei-Jun Wang, Shenzhen (CN); Zi-Ming Tang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 400 days.

(21) Appl. No.: 12/509,557

(22) Filed: Jul. 27, 2009

(65) Prior Publication Data

US 2010/0326806 A1 Dec. 30, 2010

(30) Foreign Application Priority Data

Jun. 30, 2009 (CN) ..... 2009 1 0303882

(51) Int. Cl.
*H01H 13/14* (2006.01)
*H01H 3/12* (2006.01)

(52) U.S. Cl. ..... 200/341

(58) Field of Classification Search ..... 200/341
See application file for complete search history.

(56) References Cited

U.S. PATENT DOCUMENTS 7,312,411 B2 * 12/2007 Osada ..... 200/6 A

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A pushbutton for an electronic device includes a pushbutton cap, a pushbutton base, and an adhesive member. The pushbutton cap has a flange extending from an edge thereof. The pushbutton base engages with the flange of the pushbutton cap, thus enveloping the adhesive member between the pushbutton cap and the pushbutton base.

8 Claims, 2 Drawing Sheets

PUSHBUTTON FOR ELECTRONIC DEVICE

BACKGROUND

1. Technical Field

The present disclosure relates generally to device controls and, more particularly, to a pushbutton for an electronic device.

2. Description of Related Art

Electronic devices generally have a plurality of controls, such as pushbuttons, for convenient operation. The pushbuttons correspond to different functions, such as turning power on and off.

A typical pushbutton includes a pushbutton cap and a pushbutton base. The pushbutton cap engages the pushbutton base. However, it can be difficult to align the pushbutton cap with the pushbutton base during assembly, and the pushbutton cap may easily loosen from the pushbutton base when in use. Thus, smooth and quick operation of the pushbutton may be compromised. In addition, the pushbutton cap often needs to be identified with a graphic or character. Precisely applying such labeling may be problematic due to the difficulty in positioning the pushbutton cap.

Therefore, a pushbutton which overcomes the described limitations is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
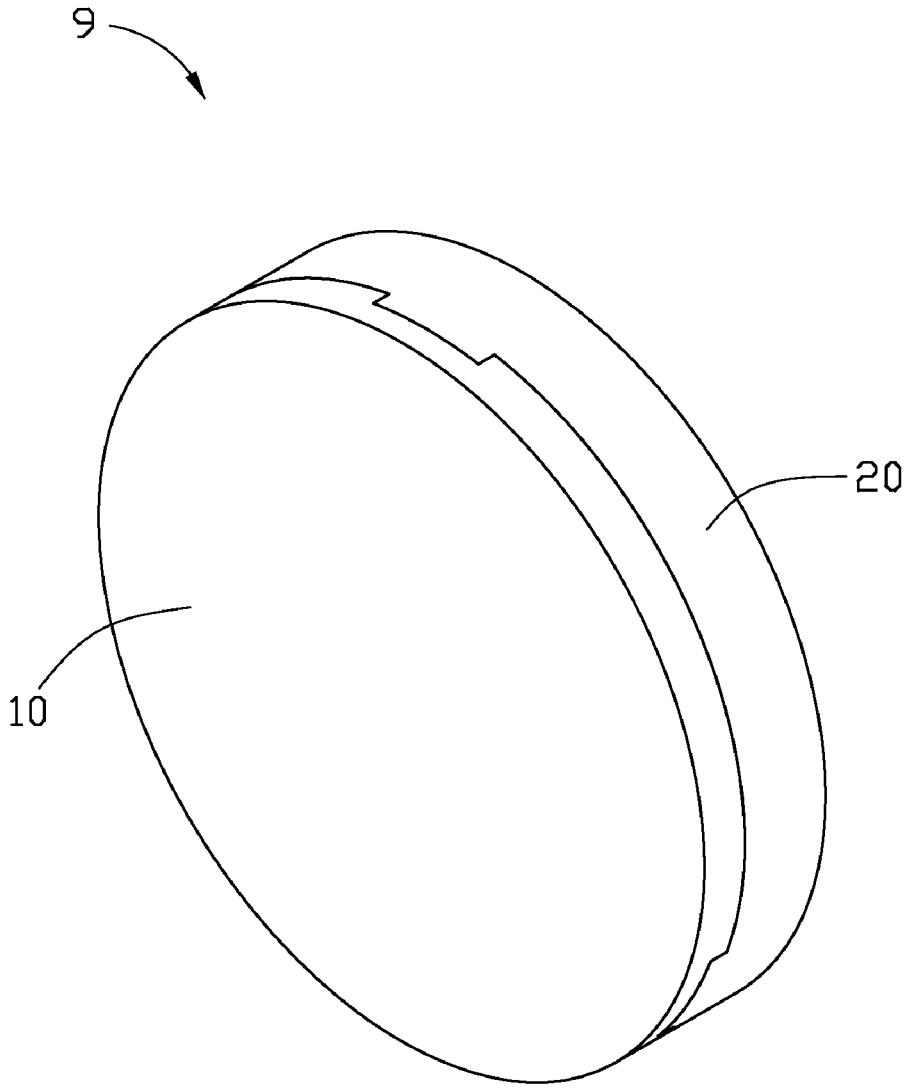
FIG. 1 is an isometric view of an embodiment of a pushbutton.
Figure 2:
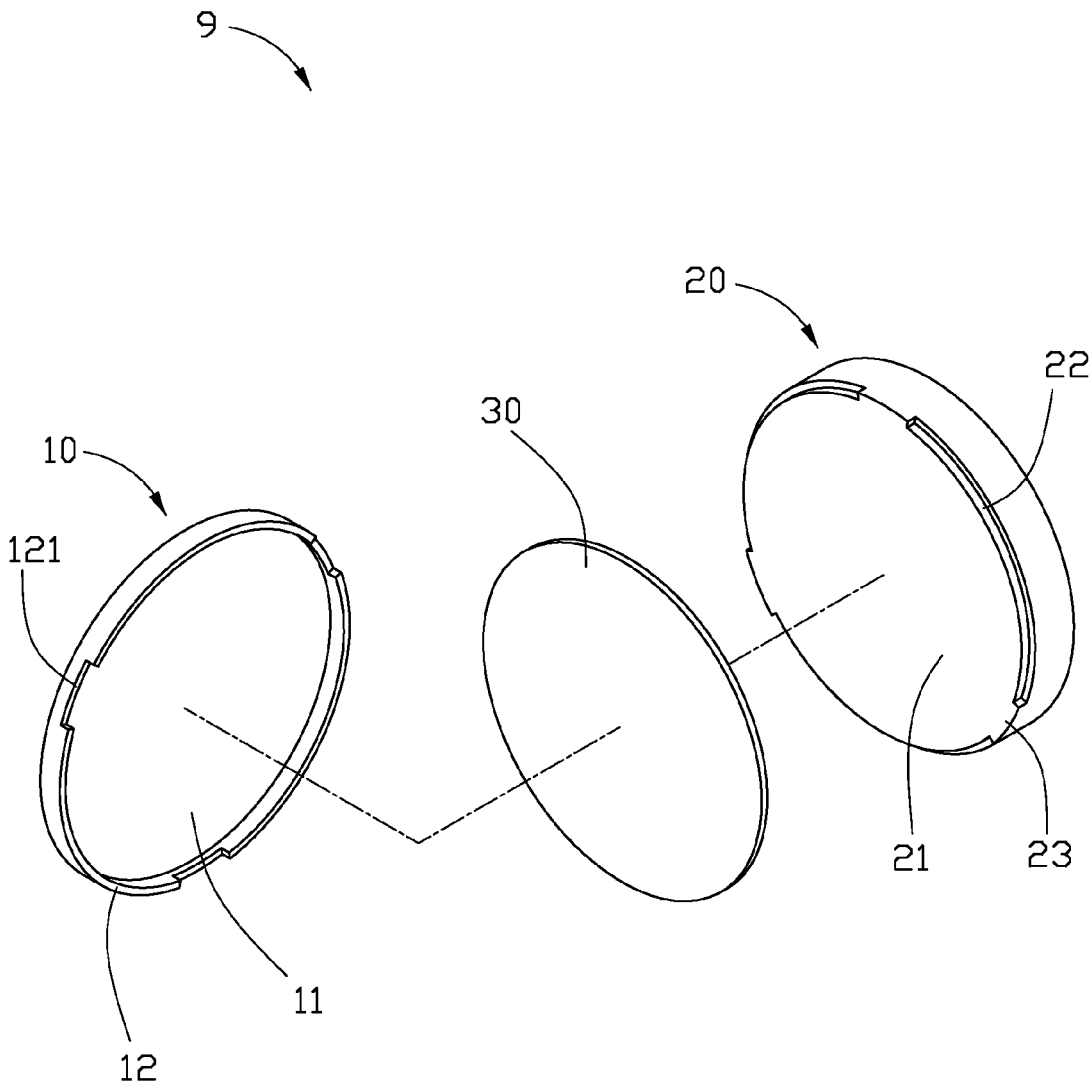
FIG. 2 is an exploded view of the pushbutton of FIG. 1.

Referring to FIGS. 1 and 2, an embodiment of a pushbutton 9 for an electronic device includes a pushbutton cap 10, a pushbutton base 20, and an adhesive member 30 positioned therebetween. In the illustrated embodiment, the adhesive member 30 is double-sided adhesive tape material. That is, the adhesive member 30 is adhesive on both of opposite major sides thereof.

The pushbutton cap 10 includes a flat, circular assembly surface 11, and an annular flange 12 extending from an edge of the assembly surface 11. The flange 12 defines one or more positioning cutouts 121. In the illustrated embodiment, the flange 12 defines three positioning cutouts 121 evenly angularly spaced from one another. An arc-length of each positioning cutout 121 is less than an arc-length of each portion of the flange 12 between any two positioning cutouts 121. A distance from an edge of the flange 12 in the positioning cutout 121 to the assembly surface 11 exceeds a thickness of the adhesive member 30.

The pushbutton base 20 is substantially cylindrical in this embodiment. The pushbutton base 20 includes a flat (planar) contact surface 21. One or more arc-shaped restricting grooves 22 and one or more arc-shaped positioning protrusions 23 are formed at a peripheral edge of the contact surface 21. In the illustrated embodiment, three restricting grooves 22 and three positioning protrusions 23 are formed at the peripheral edge of the pushbutton base 20 in an alternating manner.

A top surface of each positioning protrusion 23 is coplanar with the contact surface 21. The adhesive member 30 is substantially circular.

During assembly of the pushbutton 9, the adhesive member 30 is applied to the assembly surface 11 of the pushbutton cap 10. Next, the portions of the flange 12 between the positioning cutouts 121 engage in the restricting grooves 22 of the pushbutton base 20, with the positioning protrusions 23 being received in the positioning cutouts 121 of the pushbutton cap 10. The adhesive member 30 is thus applied to the contact surface 21 of the pushbutton base 20. As a result, the adhesive member 30 is sandwiched and enclosed between the pushbutton cap 10 and the pushbutton base 20, providing adhesion therebetween. In the illustrated embodiment, the portions of the flange 12 between the positioning cutouts 121 fittingly engage in the restricting grooves 22 of the pushbutton base 20, with the positioning protrusions 23 being fittingly received in the positioning cutouts 121 of the pushbutton cap 10.

Because the positioning protrusions 23 of the pushbutton base 20 are received in the positioning cutouts 121 of the pushbutton cap 10, the pushbutton cap 10 is easily aligned with the pushbutton base 20. The adhesive member 30 cannot overflow or protrude from the pushbutton 9 because the adhesive member 30 is enclosed by the pushbutton cap 10 and the pushbutton base 20. Thus, the function and use of the pushbutton 9 can be more effective and comfortable. In addition, when the pushbutton cap 10 is to be labeled, the positioning and fixing of the pushbutton cap 10 are enhanced, thereby improving the labeling precision of the pushbutton cap 10.

In alternative embodiments, the pushbutton cap 10 can have other shapes. For example, the pushbutton cap 10 may be rectangular, with the pushbutton base 20 being correspondingly rectangular. In other alternative embodiments, the adhesive member 30 can be or include other kinds of adhesive material, such as mucilage.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A pushbutton for an electronic device, comprising:

a pushbutton cap comprising a flange extending from an edge thereof, and an assembly surface surrounded by the flange;

a pushbutton base defining a contact surface, and an adhesive member fixing the assembly surface to the contact surface;

wherein the pushbutton base engages with the flange of the pushbutton cap, thus enveloping the adhesive member between the pushbutton base and the pushbutton cap; the flange defining a plurality of positioning cutouts, and at least one positioning protrusion is formed on the pushbutton base, the at least one positioning protrusion engaging in the at least one positioning cutout; and an arc-length of each positioning cutout is less than an arc-length of each portion of the flange between any two positioning cutouts of the plurality of positioning cutouts.

2. The pushbutton of claim 1, wherein both the assembly surface and the contact surface are flat.

3. The pushbutton of claim 1, wherein a distance from an edge of the flange in each positioning cutout to the assembly surface exceeds a thickness of the adhesive member.

4. The pushbutton of claim 1, wherein the at least one positioning protrusion is arc-shaped.

5. The pushbutton of claim 1, wherein the at least one positioning protrusion is fittingly engaged in the at least one positioning cutout.

6. The pushbutton of claim 1, wherein the flange is annular, and the pushbutton base is substantially cylindrical.

7. The pushbutton of claim 6, wherein the adhesive member is circular and is surrounded by the flange.

8. The pushbutton of claim 1, wherein the adhesive member comprises double-sided adhesive tape material.

* * * * *